US007708615B2

(12) United States Patent
Munch

(10) Patent No.: US 7,708,615 B2
(45) Date of Patent: May 4, 2010

(54) TOY BUILDING SYSTEM WITH FUNCTION BRICKS

(75) Inventor: Gaute Munch, Langa (DK)

(73) Assignee: Lego A/S, Billund (DK)

( * ) Notice: Subject to any disclaimer, the term of this patent is extended or adjusted under 35 U.S.C. 154(b) by 309 days.

(21) Appl. No.: 11/665,659

(22) PCT Filed: Oct. 19, 2005

(86) PCT No.: PCT/DK2005/000675

§ 371 (c)(1),
(2), (4) Date: Sep. 10, 2007

(87) PCT Pub. No.: WO2006/042549

PCT Pub. Date: Apr. 27, 2006

(65) Prior Publication Data

US 2008/0220690 A1 Sep. 11, 2008

(30) Foreign Application Priority Data

Oct. 20, 2004 (DK) ..... 2004 01612

(51) Int. Cl.
*A63H 33/10* (2006.01)
*A63H 33/00* (2006.01)

(52) U.S. Cl. ..... 446/91; 446/484

(58) Field of Classification Search ..... 446/85, 446/91, 117, 118, 119, 124–128, 484
See application file for complete search history.

(56) References Cited

U.S. PATENT DOCUMENTS

| | | | | |
|---|---|---|---|---|
| 3,005,282 | A * | 10/1961 | Christiansen | 446/128 |
| 4,712,184 | A | 12/1987 | Haugerud | |
| 4,743,202 | A * | 5/1988 | Bach | 439/53 |
| 5,411,428 | A * | 5/1995 | Orii et al. | 446/90 |
| 5,435,769 | A | 7/1995 | Bertrand | |
| 5,742,486 | A * | 4/1998 | Yangkuai | 361/807 |
| 6,206,745 | B1 | 3/2001 | Gabai et al. | |
| 6,443,796 | B1 | 9/2002 | Shackelford | |
| 6,679,751 | B1 * | 1/2004 | Maxwell et al. | 446/91 |
| 6,773,322 | B2 | 8/2004 | Gabai et al. | |

FOREIGN PATENT DOCUMENTS

WO WO 01/97937 A1 12/2001

* cited by examiner

*Primary Examiner*—Kien T Nguyen
(74) *Attorney, Agent, or Firm*—Day Pitney LLP

(57) ABSTRACT

A toy building system with function bricks adapted to perform a function in response to a mechanical trigger action; sensor bricks with a sensor adapted to produce an output in response to a mechanical trigger action; and logic bricks with an input responsive to a sensor brick output and adapted to perform a logic function on the sensor brick output and to produce a logic output. The sensor brick output and the logic brick output are arranged in a first uniform manner relative to the coupling means, and the sensor output action and the logic output action are of uniform physical nature. The logic brick input and the function brick input are arranged in a second uniform manner relative to the coupling means. The function brick input is responsive to a logic brick output and adapted to perform the function in response to a logic brick output.

18 Claims, 3 Drawing Sheets

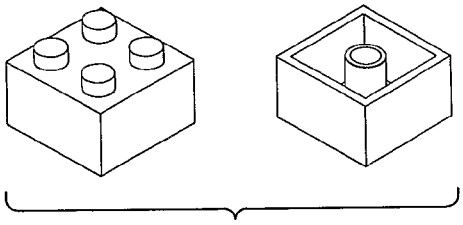
Fig. 1 - PRIOR ART
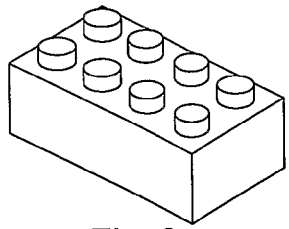
Fig. 2
PRIOR ART
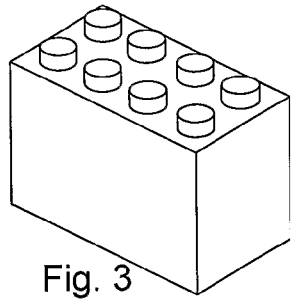
Fig. 3
PRIOR ART
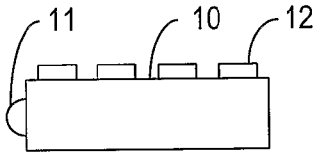
Fig. 4
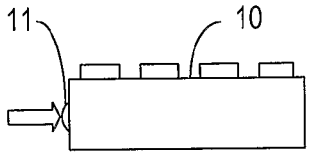
Fig. 4A
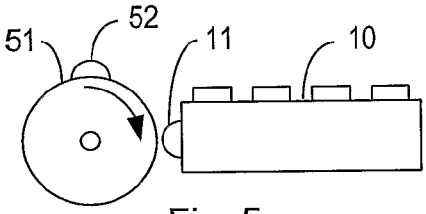
Fig. 5
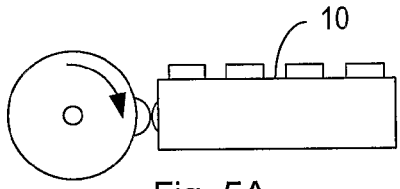
Fig. 5A
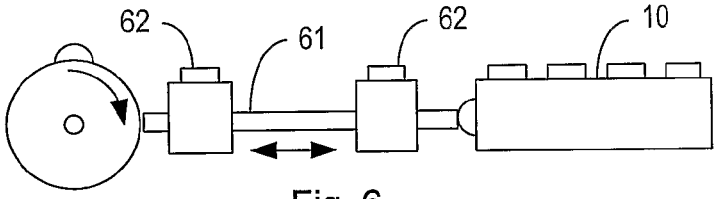
Fig. 6
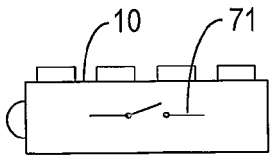
Fig. 7
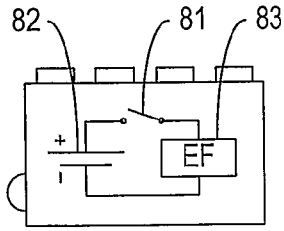
Fig. 8
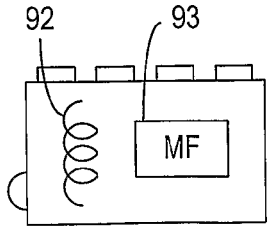
Fig.9

TOY BUILDING SYSTEM WITH FUNCTION BRICKS

FIELD OF THE INVENTION

The invention relates to toy building systems comprising building elements with coupling means for releasably interconnecting building elements.

BACKGROUND OF THE INVENTION

Such toy building systems have been known for decades. The simple building blocks have been supplemented with dedicated building elements with either a specific appearance or a mechanical or electrical function to enhance the play value. Such functions include e.g. motors, switches and lamps, but also programmable processors that accept input from sensors and can activate function elements in response to received sensor inputs.

Self-contained function building elements exist which have a function device adapted to perform a preconfigured function, an energy source for providing energy to the function device for performing the function, and a trigger responsive to an external trigger event to trigger the function device to perform the function. Typically, such known function building elements are designed for manual activation of the trigger and only provide a limited play value.

It is thus the purpose of the invention to provide a toy building system with new building elements that are suitable for use in the system, and that will enhance the play value of the system.

SUMMARY OF THE INVENTION

This purpose is achieved by the toy building system of the invention where the system comprises either one or more sensor building elements, or one or more logic building elements or one or more function building elements all having coupling means to make them compatible with the toy building system. The invention is generally applicable to toy building systems with building elements having coupling means for releasably interconnecting building elements.

In particular, when each function building element has a function device adapted to perform a preconfigured function and an energy source for providing energy to the function device for performing the function, and a trigger responsive to an external mechanical trigger action to trigger the function device to perform the function, wherein the trigger in each function building element is arranged in a uniform manner relative to the coupling means, function elements can easily be interchanged within a given toy construction without having to change the trigger mechanism.

Mechanical trigger inputs further provide a simple and robust trigger mechanism that does not rely on electrical connections or other complicated and error-prone mechanisms. Furthermore, such mechanical trigger mechanisms are intuitive and easy to work with, even for smaller children.

Consequently, function building elements with mechanical triggers in a standardized place, make the function building elements suited for use in toy building systems, and increase the play value.

In some embodiments, the toy building set includes one or more sensor building elements and optionally one or more logic building elements, each having mechanical trigger outputs arranged in a uniform manner adapted to activate the triggers of the function building elements. Consequently, a building set is provided that allows a user to construct a large variety of functions and functional relationships in a uniform manner and with a limited set of different construction elements.

BRIEF DESCRIPTION OF THE DRAWINGS

FIGS. 1-3 each show a prior art toy building brick,

FIG. 4 shows a toy building brick of the invention,

FIG. 4A illustrates the activation of the toy building brick in FIG. 4,

FIGS. 5 and 5A show the toy building brick in FIG. 4 when used in a toy building system that activates the toy building brick, FIG. 6 illustrates an alternative structure for activating the toy building brick, FIG. 7 illustrates schematically a toy building brick with a switch, FIG. 8 illustrates schematically a function building brick with an electrical function and a battery for powering the electrical function, FIG. 9 illustrates schematically a function building brick with a mechanical function and a spring for powering the mechanical function.

DETAILED DESCRIPTION OF THE INVENTION

Figure 10:
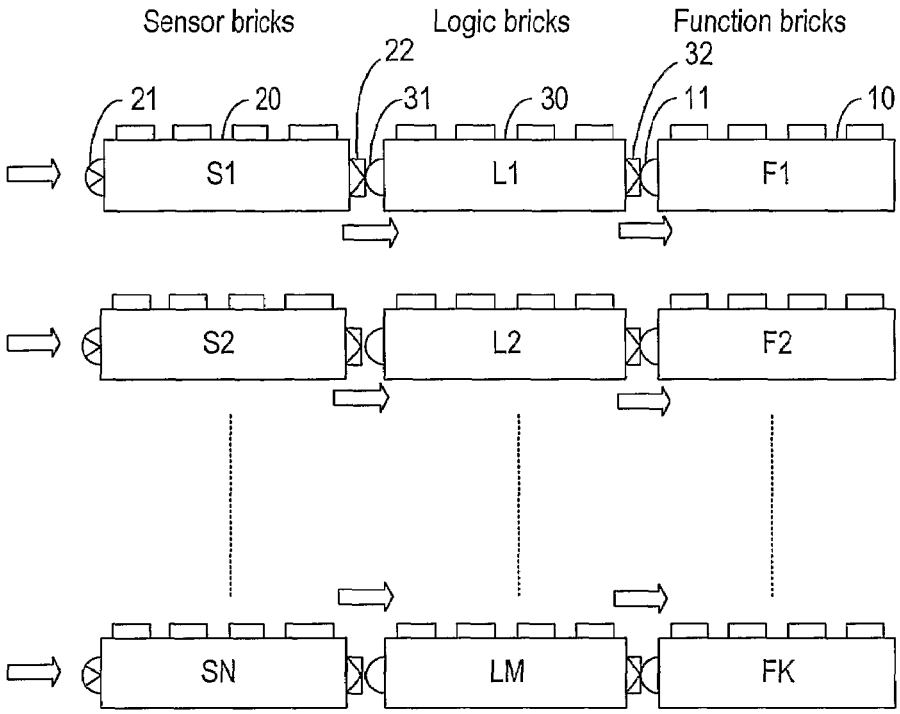
FIG. 10 illustrates a toy building system of the invention comprising sensor bricks, logic bricks and function bricks.

The invention will be described using toy building elements in the form of bricks. However, the invention may be applied to other forms of building elements used in construction building sets.

In FIG. 1 is shown a toy building brick with coupling studs on its top surface and a cavity extending into the brick from the bottom. The cavity has a central tube, and coupling studs on another brick can be received in the cavity in a frictional engagement as disclosed in U.S. Pat. No. 3,005,282. FIGS. 2 and 3 show other such prior art building bricks. The building bricks shown in the remaining figures have this known type of coupling means in the form of cooperating studs and cavities. However, other types of coupling means may also be used.

FIG. 4 shows a toy building brick 10 with a push button 11 on one of the side faces and coupling studs 12 on its top surface. In the shown embodiment the toy building element 10 illustrates a function building element where the push button 11 provides a mechanical input or trigger for activating a function device in the building element 10 as illustrated in FIG. 4A, where a mechanical force is applied to the trigger and pushes the trigger into the brick, whereby a function device in the brick is activated.

Generally, the force may be applied by an external triggering member, e.g. a triggering member that engages the trigger by means of physical contact. The external trigger member may e.g. be a human finger or be provided by a mechanism in the toy building set. In particular, when the toy building brick 10 is used as a part of a system that includes a sensor and/or logic brick as described below, the force may be applied by a mechanical output member of said sensor or logic brick, e.g. by means of a direct physical contact or via an intermediary member such as a rod, a pin, a wheel, or the like. Examples of such output members include a shaft, a pin, a cam wheel, a hinged or pivoting member, or the like.

FIG. 5 illustrates a rotating wheel 51 with a cam 52 on its periphery. When the wheel 51 rotates the cam 52 will activate the button 11 once every revolution of the wheel 51 as illustrated in FIG. 5A.

In FIG. 6 the cam activates the push button 11 indirectly via an intermediate push rod 61 that is arranged in through-holes in two supporting building bricks 62. The push rod 61 is preferably of the type having a cross-shaped cross-section, and the push button 11 preferably has a hole with a corresponding cross-section for receiving an end of the push rod.

In FIG. 7 is illustrated that the function device in the brick 10 can be a switch 71. The switch 71 can be a normally open or a normally closed switch, and its terminals can be connected to the coupling studs on the top surface or to the surfaces in the cavity that are intended for engaging coupling studs on other building bricks.

In FIG. 8 is illustrated a function brick that has a battery 82 that store electrical energy, and a switch 81 can be activated by the push button, whereby an electrical function device 83 receives electric power from the battery 82, and the electrical function device 83 performs a preconfigured electrical function.

In FIG. 9 is illustrated a function brick that has a spring 92 that stores mechanical energy that by activating the push button can be released and supplied to a mechanical function device 93 for performing a preconfigured mechanical function.

Examples of the preconfigured mechanical function that the function bricks of the invention can perform include driving a rotating output shaft, winding-up a string or a chain which enables pulling an object closer to the function brick, fast or slow moving a hinged part of the function brick which enables e.g. opening or closing a door, ejecting an object, etc. Such mechanical motions can be driven by an electric motor powered by a battery 82 or a rechargeable electric capacitor, or by a spring 92 or other resilient member or compressed air.

Examples of the preconfigured electrical function that the function bricks of the invention can perform include operating a switch with accessible terminals, emitting constant or blinking light, activating several lamps in a predetermined sequence, emitting audible sound such as beep, alarm, bell, siren, voice message, music, synthetic sound, natural or imitated sound simulating and stimulating play activities, recording and playback of a sound, emitting inaudible sound such as ultrasound, emitting a radio frequency signal or an infrared signal to be received by another component, etc.

Hence, the function device may include any suitable mechanical and/or electrical device, arrangement or circuitry adapted to perform one or more of the above or alternative functions. Examples of function devices include a light source such as a lamp or LED, a sound generator, a motor, a hinged part, a rotatable shaft, a signal generator, or the like.

In a more general embodiment of the function brick 10 the input 11 is a mechanical trigger device/element. The mechanical trigger is responsive to external mechanical actions/events such as mechanical forces, push, pull, rotation, pressure, an impulse, touch, a momentum, an angular momentum, or the like. The mechanical trigger may be a trigger element known per se, and the skilled person will know how to select a trigger that suits a particular purpose. When activated by a sensed external mechanical event, a function device in the brick will be activated to perform a function as described above.

It is a common feature of the function bricks that the trigger or input of each brick is arranged in a first uniform manner relative to the coupling means, i.e. to the coupling studs on the top surface and/or to the coupling cavity in the bottom. This makes the function bricks interchangeable, and in a toy construction built with bricks as in FIGS. 1-3 several function bricks can be used interchangeably, and a particular function brick can be used in several constructions. A toy building system may comprise several of such function bricks responsive to different external mechanical actions. Nevertheless, if all function bricks include corresponding trigger elements that are responsive to the same mechanical actions in a uniform manner, such function bricks may easily be interchanged within a toy construction built from the building bricks described herein. For example, a function brick including a lamp may simply be replaced by a function brick including a sound source or loudspeaker, without having to change any other part of the construction, since both function bricks are activated in the same way.

FIG. 10 illustrates three groups of toy building bricks: sensor bricks (S1, S2, . . . , SN), logic bricks (L1, L2, . . . , LM) and function bricks (F1, F2, . . . , FK) for use in a toy building set comprising building elements with coupling means for releasably interconnecting building elements, e.g. the known bricks shown in FIGS. 1-3. The function bricks are described above.

Sensor bricks 20 each have a sensor 21 that is responsive to an external physical event symbolized by an arrow. Examples of such external physical events comprise mechanical forces, push, pull, rotation, human manipulation, touch, proximity of an object, electrical signals, radio frequency signals, optical signals, visible light signals, infrared signals, magnetic signals, temperature, humidity, radiation, etc. Preferably, each sensor is responsive to only a particular type of such physical events, thereby providing a number of different sensor bricks S1, S2, . . . , SN.

Each sensor brick 20 has an output 22, and when an external physical event has reached the sensor, the sensor brick will respond by outputting a mechanical output action on its output 22. All sensor bricks preferably output an output action of uniform nature as to impart a force, a momentum, an angular momentum, or the like on a corresponding trigger input. For example, the output 22 may include an output member that performs a translational movement (e.g. a push or pull) or a rotation of an output member such as a shaft or pin, thereby conveying a mechanical force and/or momentum and/or angular momentum. Preferably, all sensor brick outputs are arranged in a second uniform manner relative to the coupling means, i.e. to the coupling studs on the top surface and/or to the coupling cavity in the bottom. Furthermore, in some embodiments, all sensor bricks provide a mechanical output of a uniform nature such that the sensor brick outputs cooperate with the trigger inputs of the function bricks and/or logic bricks as to impart a mechanical action of a uniform nature, such as a predetermined force or momentum. This makes the sensor bricks interchangeable, and in a toy construction built with bricks as in FIGS. 1-3 several sensor bricks can be used interchangeably, and a particular sensor brick can be used in several constructions.

Sensor bricks can be used alone with the toy building set or in combination with one or more function bricks described above.

Logic bricks 30 each have a mechanical input 31 and a mechanical output 32. The input 31 of a logic brick 30 accepts an output action from the output 22 of any sensor brick 20. The logic bricks 30 are adapted to perform a logic function on the logic brick input action and to output an output action that is a result of the logic function performed on the logic brick input action. Preferably, the output action from the logic bricks 30 are of the same mechanical nature as the output actions from the sensor bricks 20, which means that both sensor bricks and logic bricks output e.g. an electrical or a mechanical action. Furthermore, in preferred embodiments, the logic brick inputs are adapted to be responsive to the same mechanical inputs as the function brick inputs.

Examples of logic functions performed by the logic bricks comprise delay output relative to input, repeat input a predetermined number of times on output, output only if input meets certain criteria e.g. a certain sequence or pattern is received as input, output a predetermined sequence or pattern of output actions. Hence in a toy building set there may be a number of different logic bricks L1, L2, . . . , LM allowing to implement different logic functions by simply interchanging the logic bricks in a given construction.

Figure 11:
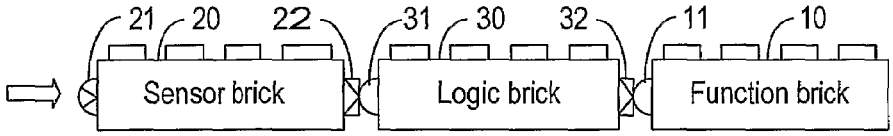
FIGS. 11-13 illustrate different uses of the toy building system in FIG. 10.

In FIG. 11 is illustrated an intended use of the sensor, logic and function bricks in FIG. 10. A sensor brick 20, a logic brick 30 and a function brick 10 are arranged in series as shown, and they may be interconnected with other building bricks of the toy building system. The sensor brick 20 responds to an external physical event (the arrow) that is sensed by the sensor 21 by giving an output action on its output 22. The logic brick 30 receives the output action from the sensor brick 20 on its input 31. The logic brick 30 performs a logic function on the action received from the sensor brick and generates a corresponding output action on its output 32. The function brick 10 receives the output action from the logic brick 30 on its input 11 and performs its function. Each of the sensor bricks, the logic bricks and the function bricks are interchangeable with other bricks from the same group. Hence, when a toy construction set includes several function bricks and/or several sensor bricks and/or several logic bricks with uniform mechanical inputs and outputs, a large variety of different functions triggered by different sensor inputs may be constructed simply by interchanging the various bricks. Since all mechanical interfaces are arranged in a uniform manner with respect to the coupling means and operate in a uniform manner, the various bricks can easily be interchanged within a construction.

Figure 12:
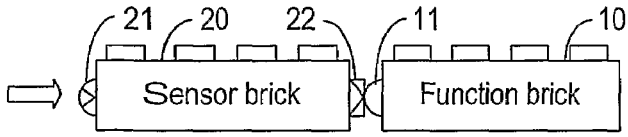

In FIG. 12 is illustrated another intended use of the sensor and function bricks in FIG. 10. The difference from FIG. 11 is that a logic brick is missing. A sensor brick 20 and a function brick 10 are arranged in series as shown, and they may be interconnected with other building bricks of the toy building system. The sensor brick 20 responds to an external physical event (the arrow) that is sensed by the sensor 21 by giving an output action on its output 22. The function brick 10 receives the output action from the sensor brick 20 on its input 11 and performs its function. Each of the sensor bricks and the function bricks are interchangeable with other bricks from the same group.

All logic bricks and all function bricks accept the output action from any sensor brick and from any logic brick as their input action.

Figure 13:
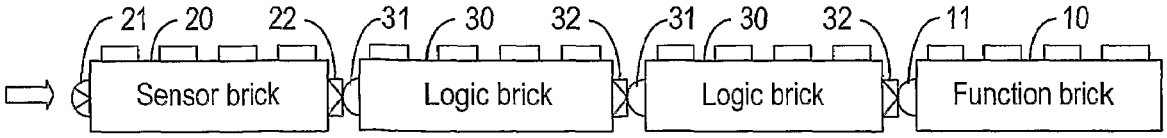

As illustrated in FIG. 13, two or more identical or different logic bricks 30 can therefore be connected in series so that a logic brick receives the output action from a preceding logic brick as its input action, whereby the combined logic function of the two logic bricks are combined before the function brick 10 is triggered to perform its function.

Preferably, the function bricks have a preconfigured function, but functions may also be programmed or otherwise determined or influenced by the user. Likewise, the logic bricks preferably have a preconfigured logic function, but logic functions may also be programmed or otherwise determined or influenced by the user.

Figure 14A:
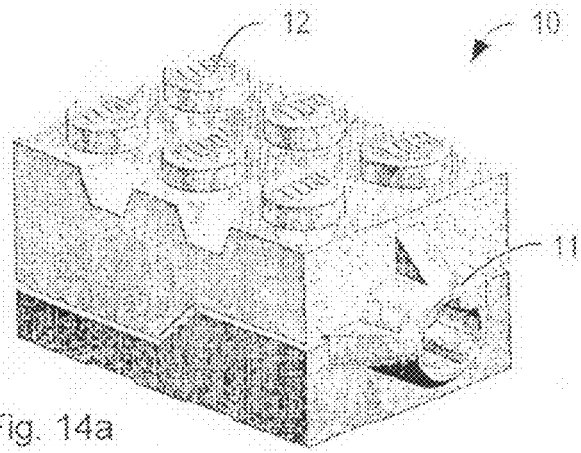
FIGS. 14-15 illustrate examples of function bricks.
Figure 14B:
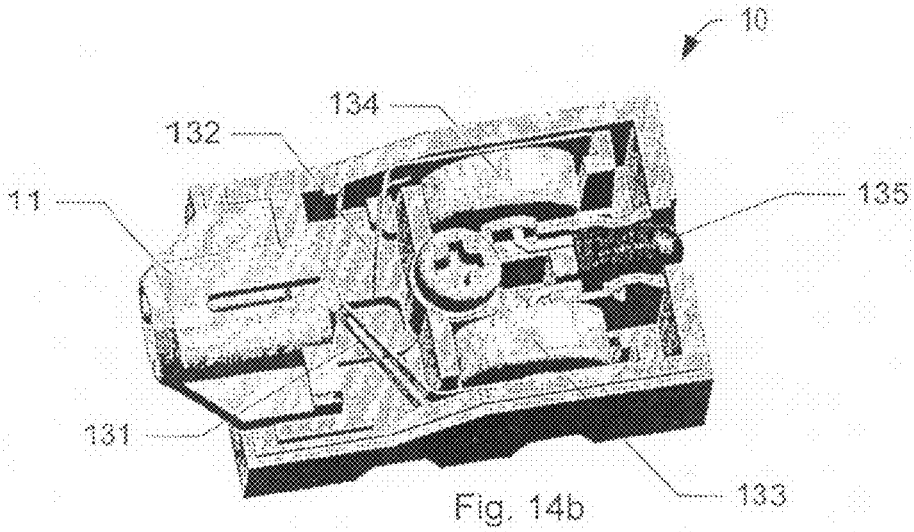

FIG. 14*a* shows a perspective view of the function brick, while FIG. 14*b* shows a schematic cross-sectional view of the brick. The function brick 10 is a building brick of the general type described in connection with FIGS. 1 and 2, and includes coupling studs on its top surface arranged in a regular pattern and in a predetermined relation to the side walls. Furthermore, the brick includes one or more corresponding cavities on the bottom surface (not explicitly shown) for frictionally engaging with the protrusions of another such bricks. The function brick comprises a trigger in the form of a push button 11 on one of its side faces. The trigger is positioned at a predetermined position on the side face and thus relative to the cavity (and/or the protrusions), e.g. at a predetermined height from the bottom surface.

The push button 11 causes, when depressed, two electrical contacts 131 and 132 to close. The contacts are connected to batteries 133 and 134, respectively. The brick 10 further includes an LED 135 electrically connected to the batteries. Consequently, as long as the push button 11 is pressed, the LED is turned on.

Figure 15:
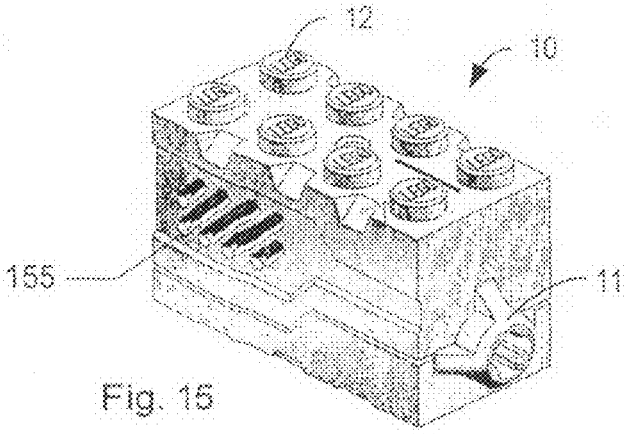

FIG. 15 shows a perspective view of another example of a function brick. The function brick 10 is similar to the function brick of FIG. 14 and comprises a push button 11 positioned at the same relative location to the cavities on the bottom surface of the brick as the push button of the function brick of FIG. 14. Furthermore, the push buttons of both bricks have the same general shape and the same manner of activation. Hence, in a construction, when the function bricks of FIGS. 14 and 15 are interchanged, the push button is positioned at the same location and can be activated in the same manner. Nevertheless, instead of the LED, the function brick 10 of FIG. 15 includes a battery-driven sound generator 155 for providing an audible output.

Generally, when the trigger inputs of the function building elements, the outputs of the sensor building elements, and the inputs and outputs of the logic elements are positioned on a sidewall of the building elements that have coupling means on their top and bottom surfaces, the inputs and outputs do not interfere with the coupling means. Furthermore, this placement of the trigger interfaces allows the construction of entire sequences or even networks of function, sensor and logic elements within one horizontal layer/plane without the need of an additional means of transmitting the trigger events, in particular without the need of any specific base plate for conveying the trigger actions/events from one building element to the next.

The invention claimed is:

1. A Toy building system comprising building elements with coupling means for releasably interconnecting building elements, the building system comprising function building elements with said coupling means and each having a function device adapted to perform a preconfigured function and an energy source for providing energy to the function device for performing the function, said function building elements having a trigger responsive to an external mechanical trigger action to trigger the function device to perform the function, wherein the trigger in each function building elements is arranged in a uniform manner relative to the coupling means.

2. A toy building system according to claim 1 wherein the function is selected from the group comprising motion, generating an audible sound signal, generating an inaudible sound signal, generating an electrical signal, generating a visible light signal, generating an invisible light signal, generating a radio frequency signal.

3. A toy building system according to claim 1 further comprising a sensor building element with such coupling means and having a sensor responsive to an external physical event, the sensor building element being adapted, in response to the external physical event, to output, on a sensor building element output, a mechanical sensor building element output action.

4. A toy building system according to claim 3 comprising a plurality of sensor building elements responsive to different external physical events.

5. A toy building system according to claim 4 wherein the external physical events are selected from the group comprising mechanical forces, push, pull, rotation, human manipulation, touch, proximity of an object, electrical signals, radio frequency signals, optical signals, visible light signals, infrared signals, magnetic signals, temperature, humidity, radiation.

6. A toy building system according to any claim 3 wherein the sensor building element output is arranged in uniform manner relative to the coupling means and such that the sensor building element output is capable of activating a trigger of a function building element when the function building element is positioned in a predetermined operative relation to the sensor building element.

7. A toy building system according to claim 1 further comprising a logic building element with said coupling means and having a trigger responsive to an external mechanical trigger action, the logic building element being adapted to, in response to the external mechanical trigger action to perform a logic function on the external mechanical trigger action and to output, on a logic building element output, a logic building element output action that is a result of the logic function performed on the external mechanical trigger action, wherein the logic building element input and the function building element input are arranged in a first uniform manner relative to the coupling means, and the function building element trigger is responsive to a logic building element output action and adapted to perform the preconfigured function in response to a logic building element output action.

8. A toy building system according to claim 7 comprising a plurality of logic building elements adapted to perform different logic functions.

9. A toy building system according to claim 8 wherein the logic functions are selected from the group comprising delay output relative to input, repeat input a predetermined number of times on output, output only if input meets certain criteria e.g. a certain sequence or pattern is received as input, output a predetermined sequence or pattern of output actions.

10. A toy building system according to claim 7, further comprising a sensor building element with said coupling means and having a sensor responsive to an external physical event, the sensor building element being adapted, in response to the external physical event, to output, on a sensor building element output, a mechanical sensor building element output action; wherein the trigger of each of the function building element and the logic building element is responsive to the sensor building element output action; wherein the sensor building element output and the logic building element output are arranged in a second uniform manner relative to the coupling means; and wherein the sensor building element output action and the logic building element output action are of uniform mechanical nature.

11. A toy building system according to claim 1 comprising a plurality of function building elements whose function devices are adapted to perform different functions.

12. A toy building system according to claim 11 wherein the functions are selected from the group comprising motion, generating an audible sound signal, generating an inaudible sound signal, generating an electrical signal, generating a visible light signal, generating an invisible light signal, generating a radio frequency signal.

13. A toy building system according to claim 1 wherein the energy source is capable of storing mechanical energy.

14. A toy building system according to claim 1 wherein the energy source is capable of storing electrical energy.

15. A toy building system according to claim 1, wherein the triggers of all function building elements are responsive to a uniform mechanical activation.

16. A toy building system according to claim 1, wherein each of the function building elements has a top surface, a bottom surface, and at least one side surface;

wherein said coupling means are placed on at least one of the top and the bottom surface; and wherein the trigger is arranged on said side surface.

17. A toy building system according to claim 1 wherein the coupling means comprise protrusions and cavities adapted to receive protrusions in a frictional engagement.

18. A toy building system comprising building elements with coupling means for releasably interconnecting building elements, the building system further comprising logic building elements with said coupling means and each having a logic building element input responsive to a mechanical logic building element input action, each logic building element being adapted to, in response to the logic building element input action to perform a logic function on the logic building element input action and to output, on a logic building element output, a mechanical logic building element output action that is a result of the logic function performed on the logic building element input action, wherein the logic building element output actions and the logic building element input actions are of uniform mechanical nature, and the logic building element inputs and the logic building element outputs are arranged in a uniform manner relative to the coupling means.

* * * * *